US006236732B1

(12) United States Patent
Griffith

(10) Patent No.: US 6,236,732 B1
(45) Date of Patent: May 22, 2001

(54) HEADPHONE CD PLAYER

(76) Inventor: Virginia Griffith, 1408 Highway 297A, Cantonment, FL (US) 32533

( * ) Notice: Subject to any disclaimer, the term of this patent is extended or adjusted under 35 U.S.C. 154(b) by 0 days.

(21) Appl. No.: 09/356,115

(22) Filed: Jul. 15, 1999

(51) Int. Cl.[7] ..... H04R 25/00
(52) U.S. Cl. ..... 381/370; 381/378; 381/371
(58) Field of Search ..... 381/370, 378, 381/388, 376, 377, FOR 149, FOR 150, 371; 379/430

(56) References Cited

U.S. PATENT DOCUMENTS 6,141,424 * 10/2000 Takiguchi et al. ..... 381/370

* cited by examiner

*Primary Examiner*—Huyen Le
*Assistant Examiner*—Phylesha L. Dabney
(74) *Attorney, Agent, or Firm*—Peter Loffler

(57) ABSTRACT

A headphone based compact disk player is designed to be worn on a user's head in normal fashion and to play a compact disk received within the device through speakers located within the device. The headphone based compact disk player has a first housing having a first speaker therein and a second housing also having a second speaker therein. A bridge connects the two housings. A playing mechanism receives the compact disk through an opening on the first housing and plays the audio track recorded on the compact disk through the speakers. Appropriate control mechanisms are located on the device.

9 Claims, 3 Drawing Sheets

HEADPHONE CD PLAYER

BACKGROUND OF THE INVENTION

1. Field of the Invention

The present invention relates to a headphone-based compact disk player.

2. Background of the Prior Art

Many joggers and other exercise-minded individuals enjoy listening to music during the workout. Typically, such an individual will have a headphone that is placed on the head and that is connected to an audio medium player, such as a tape player or a compact disk player, that is located external of the headphone, typically being clipped to a belt or otherwise being worn around the waist of the individual. Such a system is quite reliable and used by many, but it suffers from the fact that a wire must run between the headphone and the medium player, the wire potentially interfering with the movements of the wearer.

Therefore, there exists a need in the art for a headphone that is worn by a user that plays a medium having an audio track recorded thereon and that lacks a wire that can potentially interfere with the movements of the user.

SUMMARY OF THE INVENTION

The headphone compact disk player of the present invention addresses the aforementioned needs in the art. The headphone compact disk player provides a headphone to be worn on the head of a user that plays a compact disk inserted thereinto. The headphone compact disk player lacks any wires that may interfere with the normal movements of the user.

The headphone compact disk player of the present invention is comprised of a body member that has a first housing with a first side and a second side, a second housing with a third side facing the first side and a fourth side, and a generally flexible bridge connecting the first housing and the second housing. An opening is located on the first housing and is adapted to receive compact disk of the 3.5 inch format that has an audio track thereon, therethrough. A first speaker is disposed within the first housing while a second speaker is disposed within the second housing. A playing mechanism is disposed within the first housing and reads the audio track on the compact disk and plays the audio track through the first speaker and the second speaker. A power source, such as at least one battery, is disposed within the body member and provides electrical power to the playing mechanism. At least one control mechanism is located on the body member, on the first housing, the second housing or the bridge, and controls functioning of the playing mechanism. The at least one control mechanism controls the standard functions of the playing mechanism, including play, skip, stop, fast-forward, rewind, record, volume control, and eject. A first cushion member may encompass a first periphery of the first side while a second cushion member may encompass a second periphery of the third side for added comfort during wearing of the device.

BRIEF DESCRIPTION OF THE DRAWINGS

Similar reference numerals refer to similar parts throughout the several views of the drawings.

DESCRIPTION OF THE PREFERRED EMBODIMENT

Figure 1:
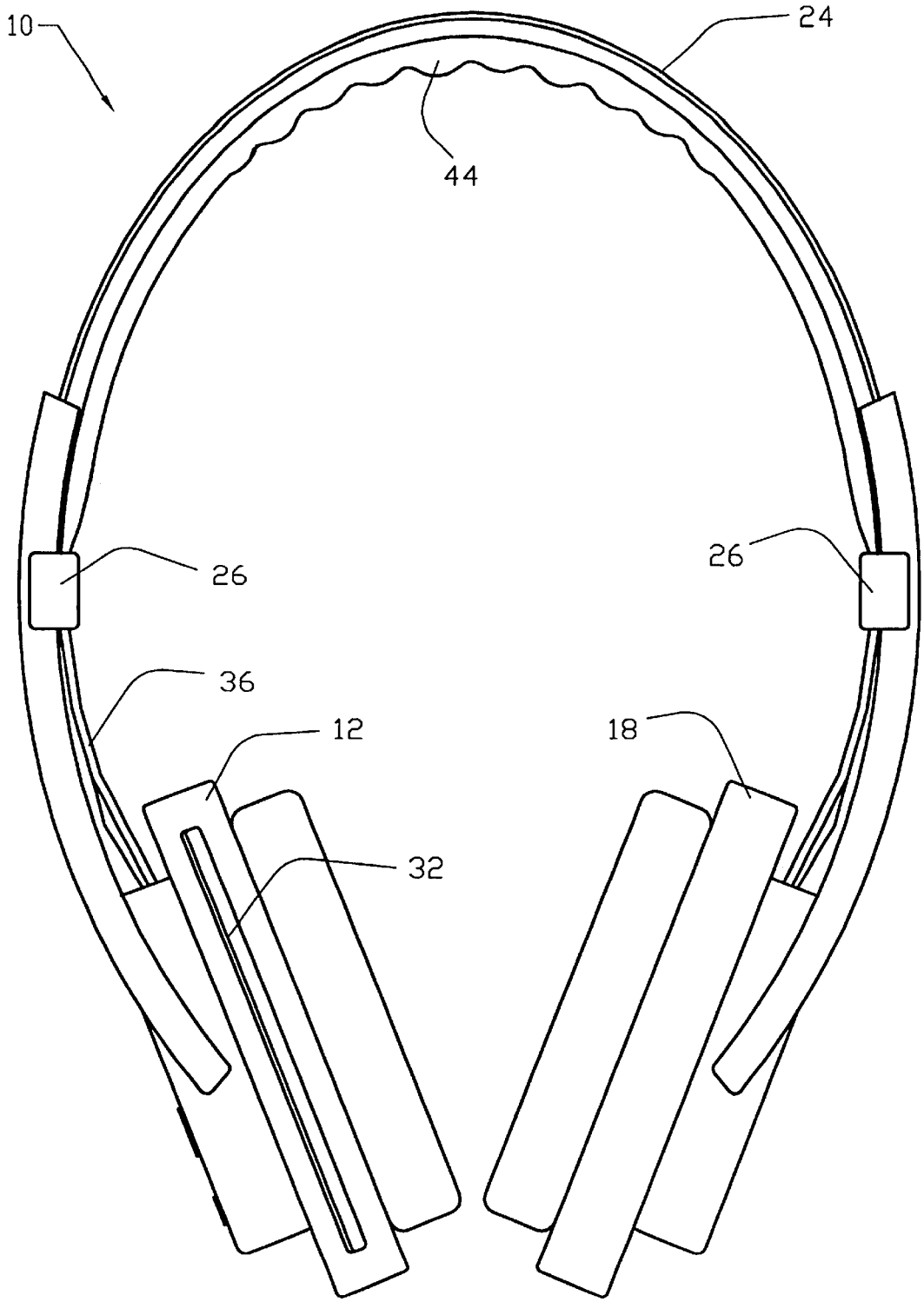
FIG. 1 is a front elevation view of the headphone compact disk player.
Figure 4:
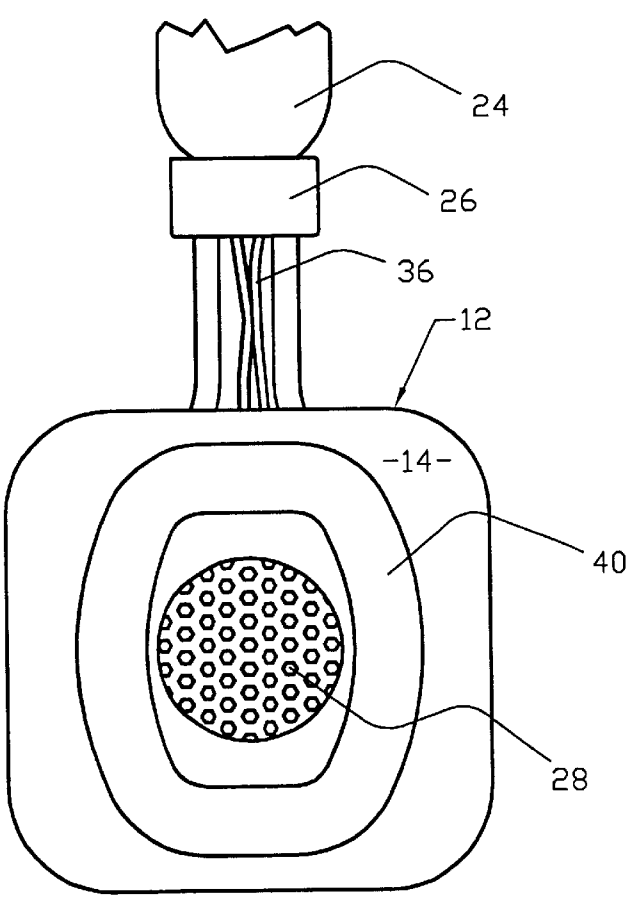
FIG. 4 is a right side elevation view of the first housing of the headphone compact disk player.
Figure 3:
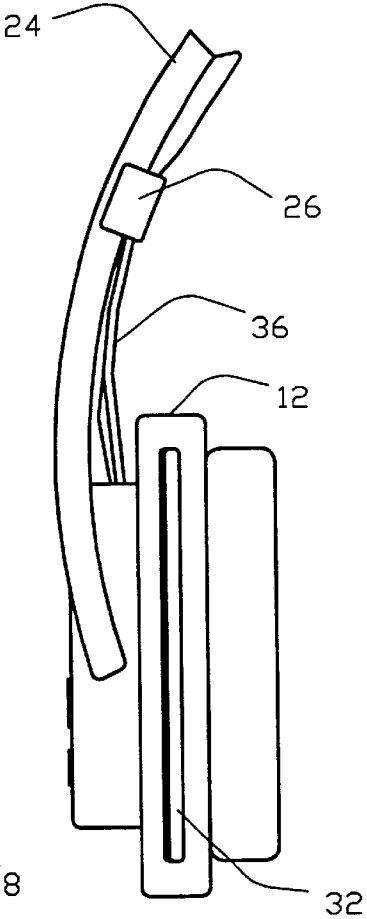
FIG. 3 is a front elevation view of the first housing of the headphone compact disk player.
Figure 2:
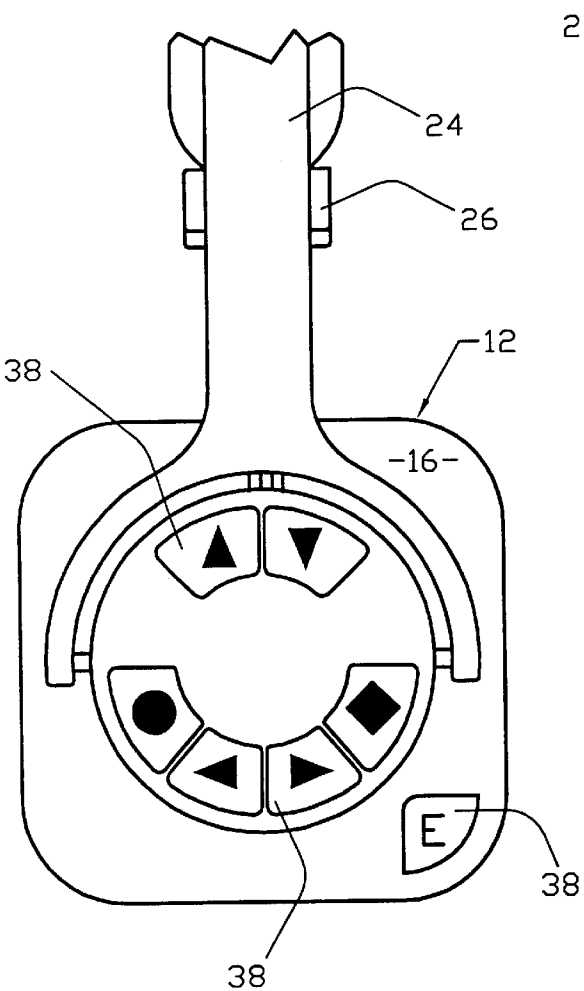
FIG. 2 is a left side elevation view of the first housing of the headphone compact disk player.
Figure 7:
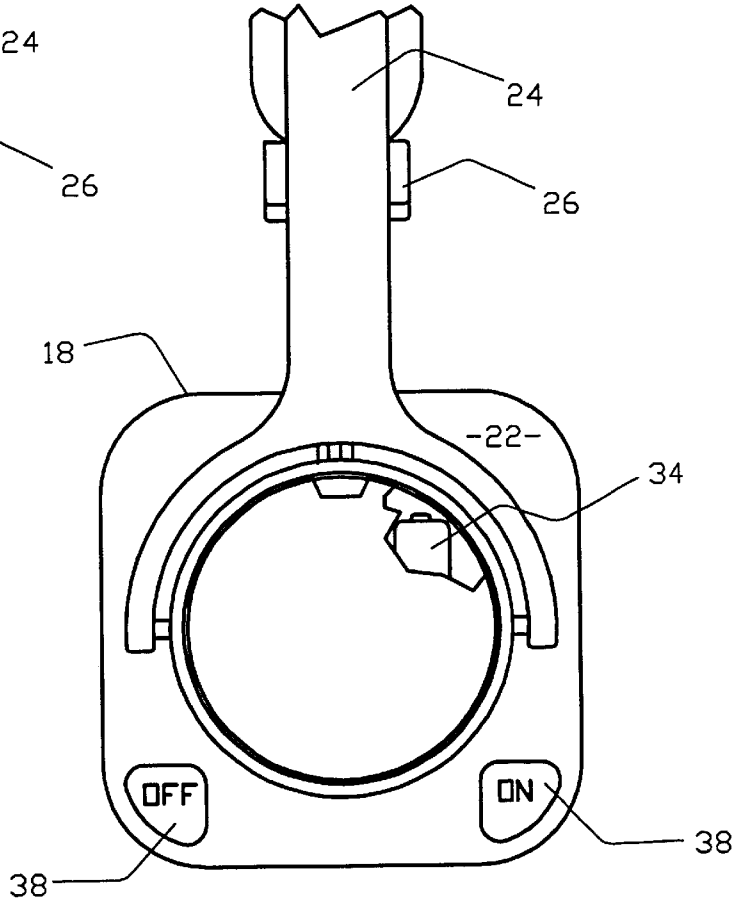
FIG. 7 is a left side elevation view, partially sectioned, of the second housing of the headphone compact disk player.
Figure 6:
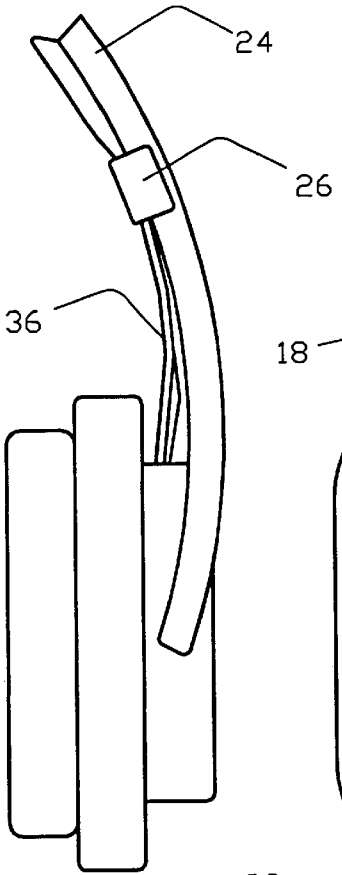
FIG. 6 is a front elevation view of the second housing of the headphone compact disk player.
Figure 5:
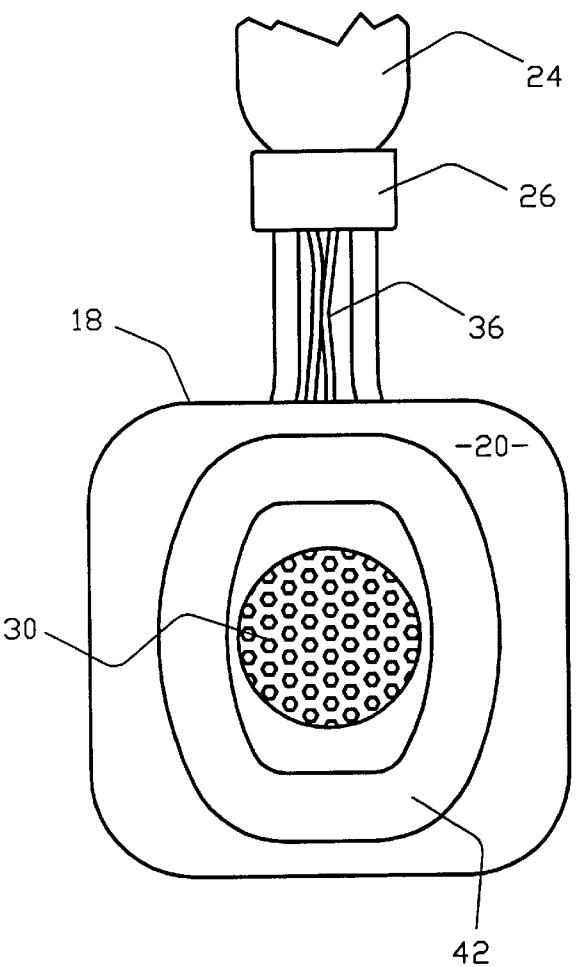
FIG. 5 is a right elevation view of the second housing of the headphone compact disk player.

Referring now to the drawings, it is seen that the headphone compact disk player of the present invention, generally denoted by reference numeral 10, is comprised of a body member that has a first housing 12 with a first side 14 and a second side 16, a second housing 18 with a third side 20 and a fourth side 22, and a bridge 24 connecting the first housing 12 and the second housing 18, the bridge 24 being made from an appropriate flexible material. If desired, appropriate length adjustment mechanisms 26 of any standard design known in the art are located on the bridge 24 for adjusting the length of the bridge 24 to fit different sized heads of the users. A first speaker 28 is disposed within the first housing 12 while a second speaker 30 is disposed within the second housing 18. A playing mechanism (not illustrated) of any conventional design known in the art is disposed within the first housing 12. A compact disk, ideally of the 3.5 inch format, and having an audio track thereon, is inserted through an opening 32 on the first housing 12 and is received by the playing mechanism for playing of the audio track through the speakers 28 and 30. An appropriate power source such as the illustrated at least one battery 34 is disposed within the body member for providing electrical power to the playing mechanism and the speakers 28 and 30. Ideally, the battery 34 will be disposed within the second housing 18 for weight balance of device 10 with appropriate wiring 36 connecting the battery 34 with the playing mechanism and the speakers 28 and 30 (it being recognized that a power source other than a battery, such as a solar collector, can be used to provide electrical power to the playing mechanism and the speakers 28 and 30). Appropriate control mechanisms 38 are used to control the playing mechanism and the speakers. The control mechanisms provide the standard controls including play, stop, rewind, fast forward, pause, on/off, record (if provided, an appropriate microphone would also be provided), volume control, and eject. The control mechanisms 38 can be located anywhere on the body member including the first housing 12, the second housing 18, both, the bridge 24 or any desired combination thereof. For comfort, a first cushion member 40 can be located on the first side 14 of the first housing 12 while a second cushion member 42 can be located on the third side 20 of the second housing 18, and a third cushion member 44 can be located on the bridge 24.

In order to use the headphone compact disk player 10 of the present invention, a user places the device 10 onto his head and uses the adjustment mechanisms to size the device 10 onto his head. The user inserts a desired compact disk through the opening 32 to be received and played by playing mechanism. The user uses the control mechanisms 38 to control the device 10 as desired.

While the invention has been particularly shown and described with reference to an embodiment thereof, it will be appreciated by those skilled in the art that various changes in form and detail may be made without departing from the spirit and scope of the invention.

What is claimed is:

1. A headphone player for playing a compact disk, the compact disk having an audio track, the headphone player comprising:

a body member that has a first housing with a first side and a second side, a second housing with a third side facing the first side and a fourth side, and a bridge connecting the first housing and the second housing;

an opening located on the first housing adapted to receive the compact disk therethrough;

a first speaker disposed within the first housing;

a second speaker disposed within the second housing;

a playing mechanism, for reading the audio track and playing the audio track through the first speaker and the second speaker, disposed within the first housing;

a power source disposed within the body member for providing electrical power to the playing mechanism, the first speaker, and the second speaker; and at least one control mechanism located on the body member for controlling the functioning of the playing mechanism.

2. The headphone player as in claim 1 wherein the compact disk that received within the first housing and that is played by the playing mechanism is of a 3.5 inch format.

3. The headphone player as in claim 1 wherein the bridge is made from a flexible material.

4. The headphone player as in claim 1 wherein the power source comprises at least one battery disposed within the second housing.

5. The headphone player as in claim 1 further comprising:

a first cushion member located on the first side; and a second cushion member located on third side.

6. The headphone player as in claim 1 wherein the at least one control mechanism controls functions of the playing mechanism, the functions being selected from the group consisting of play, skip, stop, fast-forward, rewind, record, volume control, and eject.

7. The headphone player as in claim 1 wherein the at least one control mechanism is located on the first housing.

8. The headphone player as in claim 1 wherein the at least one control mechanism is located on the second housing.

9. The headphone player as in claim 1 wherein the at least one control mechanism is located on the first housing and on the second housing.

* * * * *